US008827667B2

(12) United States Patent
Iitsuka et al.

(10) Patent No.: US 8,827,667 B2
(45) Date of Patent: Sep. 9, 2014

(54) SCROLL COMPRESSOR WITH COVER COVERING DRIVING SHAFT OF DRIVING MOTOR

(75) Inventors: Satoshi Iitsuka, Moriguchi (JP); Tsutomu Kon, Moriguchi (JP); Akihiro Hayashi, Moriguchi (JP); Katsuki Akuzawa, Moriguchi (JP); Kazuyoshi Sugimoto, Moriguchi (JP); Yasunori Kiyokawa, Moriguchi (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 151 days.

(21) Appl. No.: 13/585,299

(22) Filed: Aug. 14, 2012

(65) Prior Publication Data

US 2013/0052069 A1 Feb. 28, 2013

(30) Foreign Application Priority Data

Aug. 29, 2011 (JP) ..... 2011-185858

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 2/00*** | (2006.01) |
| ***F04C 29/02*** | (2006.01) |
| ***F04C 23/00*** | (2006.01) |
| ***F04C 18/02*** | (2006.01) |

(52) U.S. Cl.

CPC ..... *F04C 18/0215* (2013.01); *F04C 29/026* (2013.01); *F04C 23/008* (2013.01); *F04C 29/025* (2013.01)

USPC ..... 418/55.1; 418/55.5; 418/55.6; 418/57; 418/88; 418/94

(58) Field of Classification Search

CPC ..... F04C 18/0215; F04C 18/0246; F04C 23/008; F04C 29/02; F04C 29/023; F04C 29/025; F04C 29/026; F04C 29/028; F04C 29/06; F04C 29/0085; F04C 2240/10; F04C 2240/52; F04C 2240/603; F04C 2240/809; F01C 1/0215

USPC ..... 418/55.1–55.6, 57, 88, 94, 270, DIG. 1

See application file for complete search history.

(56) References Cited

U.S. PATENT DOCUMENTS

| | | | | |
|---|---|---|---|---|
| RE34,297 | E * | 6/1993 | Elson | 417/372 |
| 5,395,224 | A * | 3/1995 | Caillat et al. | 418/55.6 |
| 5,593,294 | A * | 1/1997 | Houghtby et al. | 418/55.1 |

FOREIGN PATENT DOCUMENTS

| | | |
|---|---|---|
| JP | 2004-060532 A | 2/2004 |

* cited by examiner

*Primary Examiner* — Theresa Trieu

(74) *Attorney, Agent, or Firm* — Westerman, Hattori, Daniels & Adrian, LLP

(57) ABSTRACT

A scroll compressor including a casing, a scroll compression mechanism that compresses refrigerant, a driving motor that has a driving shaft and is connected to the scroll compression mechanism through the driving shaft to drive the scroll compression mechanism, a main frame that supports the scroll compression mechanism in the casing, a bearing plate that supports the driving shaft of the driving motor in the casing and has an opening portion through which upper and lower spaces above and below the bearing plate intercommunicate with each other, and a first cover that covers the surrounding of the driving shaft between the driving motor and the bearing plate, wherein the cover is configured so as to be passable through the opening portion.

4 Claims, 4 Drawing Sheets

SCROLL COMPRESSOR WITH COVER COVERING DRIVING SHAFT OF DRIVING MOTOR

INCORPORATION BY REFERENCE

The present application claims priority under 35 U.S.C. §119 to Japanese Patent Application No. 2011-185858 filed on Aug. 29, 2011. The content of the application is incorporated herein by reference in its entirety.

BACKGROUND OF THE INVENTION

1. Field of the Invention

The present invention relates to a scroll compressor for supplying lubricant oil to the engaging portion between a fixed scroll and a swinging scroll and compressing refrigerant through the engagement between the fixed scroll and the swinging scroll.

2. Description of the Related Art

There is known a scroll compressor equipped with a compression mechanism comprising a fixed scroll and a swinging scroll that have spiral wraps engaged with each other in a hermetically sealed casing. In this scroll compressor, the compression mechanism is driven by a driving motor so that the swinging scroll makes circular motion relatively to the fixed scroll without rotating to compress refrigerant (see JP-A-2004-60532, for example).

In this type of scroll compressor, low-pressure refrigerant sucked from a suction pipe is compressed by the compression mechanism, and compressed high-pressure refrigerant is discharged from a discharge pipe provided to the casing to the outside of the casing. Furthermore, lubricant oil is supplied to each sliding portion of the compression mechanism and the engaging portion between the fixed scroll and the swinging scroll. The lubricant oil to be supplied is stocked in an oil reservoir provided at the lower portion of the casing, and surplus lubricant oil in the compression mechanism is returned to the oil reservoir by its own weight.

There is a case in this type of scroll compressor that lubricant oil is atomized in the casing due to rotation of a rotating body such as a driving shaft of the driving motor or the like. The atomized lubricant oil is mixed with high-pressure gas refrigerant to form mixed gas. The lubricant oil cannot be well separated from the mixed gas, and there may occur such a state that a large amount of atomized lubricant oil exists in the casing. Under the state that the mixed gas of a large amount of atomized lubricant oil and high-pressure refrigerant exists, a large amount of atomized lubricant oil may discharged from the discharge pipe to the outside of the casing together with the high-pressure refrigerant.

SUMMARY OF THE INVENTION

The present invention has been implemented in view of the foregoing situation, and has an object to provide a scroll compressor that can reduce a discharge amount of lubricant oil to the outside of a casing.

In order to attain the above object, there is provided a scroll compressor comprising a casing; a scroll compression mechanism that compresses refrigerant; a driving motor that has a driving shaft and is connected to the scroll compression mechanism through the driving shaft to drive the scroll compression mechanism; a main frame that supports the scroll compression mechanism in the casing; a bearing plate that supports the driving shaft of the driving motor in the casing and has an opening portion through which upper and lower spaces above and below the bearing plate intercommunicate with each other; and a first cover that covers the surrounding of the driving shaft between the driving motor and the bearing plate, wherein the cover is configured so as to be passable through the opening portion.

In the above scroll compressor, the first cover may be divided into plural cover members each of which is configured so as to be passable through the opening portion.

In the above scroll compressor, each of the cover members may comprise a cover portion disposed above the bearing plate and a fixing portion for fixing the cover portion to the bearing plate from the lower side of the bearing plate.

In the above scroll compressor, the cover members may be secured to the bearing plate so that front and rear end portions in a rotational direction of adjacent cover members are radially overlapped with each other and the front end in the rotational direction of one of the adjacent cover members is arranged inside the rear end in the rotational direction of the other cover member.

In the above scroll compressor, the first cover maybe provided with an insulator at the upper edge portion thereof.

In the above scroll compressor, the driving motor may be provided with a second cover that covers the surrounding of the driving shaft and is opened to the lower side thereof, the second cover is disposed inside the first cover, and the first cover and the second cover are arranged so that the upper end of the first cover and the lower end of the second cover are overlapped with each other in an up-and-down direction.

According to the present invention, irrespective of the specification of magnetization, the cover for preventing lubricant oil atomized due to rotation of the driving shaft from reaching a gas flow path can be secured between the driving motor and the bearing plate, so that the discharge amount of the lubricant oil to the outside of the casing can be reduced.

DETAILED DESCRIPTION OF THE EMBODIMENT

An embodiment according to the present invention will be described with reference to the drawings.

Figure 1:
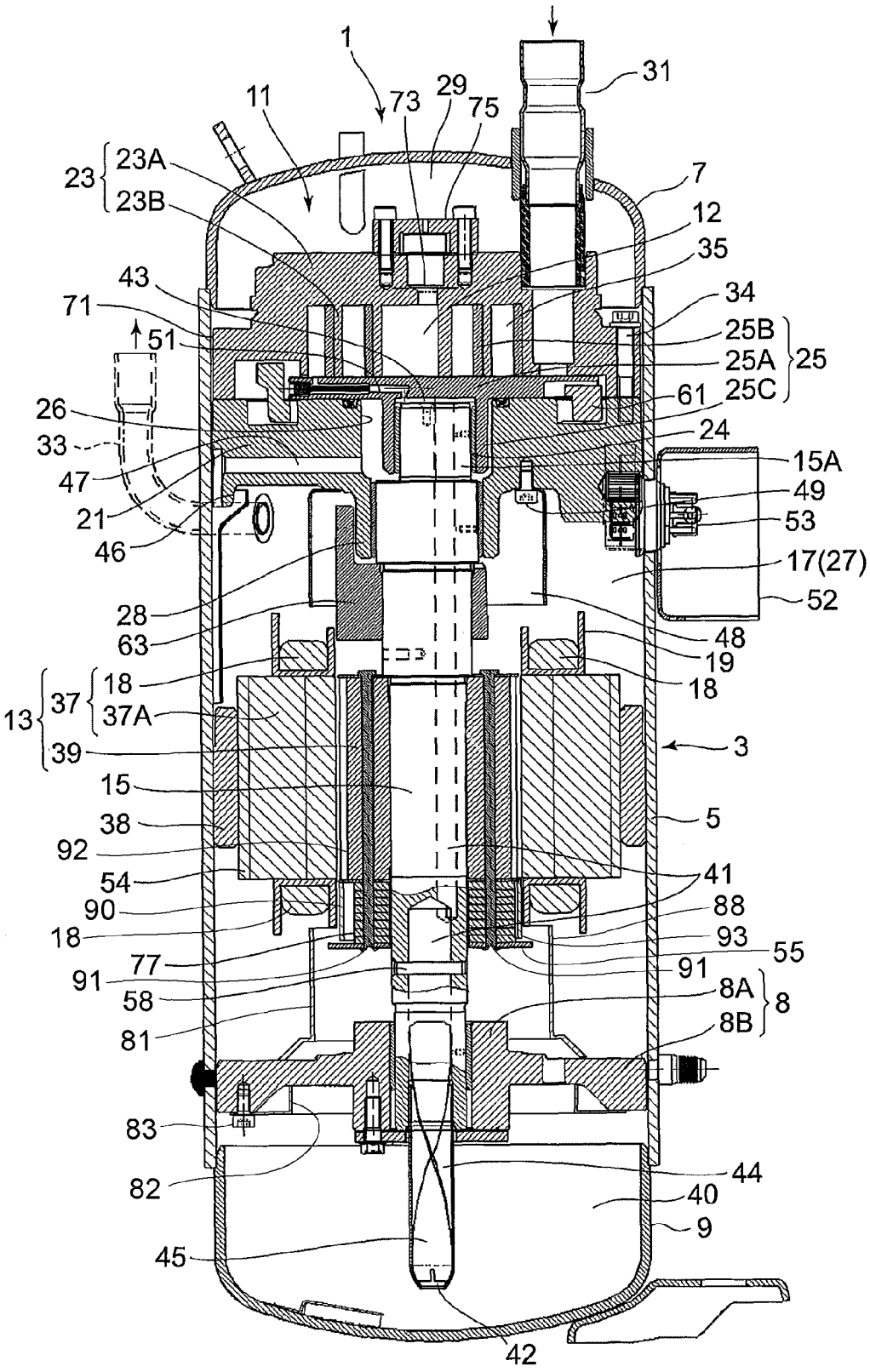
FIG. 1 is a cross-sectional view showing a scroll compressor according to an embodiment of the present invention.

FIG. 1 shows a scroll compressor 1 whose internal pressure is high. The scroll compressor 1 is connected to a refrigerant circuit (not shown) in which refrigerant is circulated to perform a refrigeration cycle operation, and compresses the refrigerant. The scroll compressor 1 has a hermetically-sealed dome type casing 3 which is designed to have an elongated cylindrical shape.

The casing 3 is configured as a pressure container having a casing body 5, an upper cap 7 and a lower cap 9. The casing body 5 constitutes a trunk portion of the casing 3, and designed in a cylindrical (barrel-like) shape having a shaft line extending in the up-and-down direction. The upper cap 7 is configured in a bowl-like shape to have an convex surface projecting to the upper side of the casing 3, and it is air-tightly welded to the upper end portion of the casing body 5 so that the upper cap 7 is integrally joined to the casing body 5. The lower cap 9 is configured in a bowl-like shape to have a convex surface projecting to the lower side of the casing 3, and it is air-tightly welled to the lower end portion of the casing body 5 so that the lower cap 9 is integrally joined to the casing body 5.

A terminal cover 52 is provided to the outer peripheral surface of the casing 3, and a power supply terminal 53 for supplying power to a stator 37 described later is provided in the terminal cover 52.

A scroll compression mechanism 11 for compressing refrigerant and a driving motor 13 disposed at the lower side of the scroll compression mechanism 11 are mounted in the casing 3. The scroll compression mechanism 11 and the driving motor 13 are joined to each other by a driving shaft 15. The driving shaft 15 is disposed along the shaft line extending in the up-and-down direction of the casing 3. A gap space 17 is formed between the scroll compression mechanism 11 and the driving motor 13.

A main frame 21 is mounted at the upper portion of the inside of the casing 3. A radial bearing portion 28 and a boss mount portion 26 are formed at the center of the main frame 21. The radial bearing portion 28 is used to pivotally support the tip (upper end) side of the driving shaft 15. The radial bearing portion 28 is formed by downwardly protruding the center portion of one surface (lower surface) of the main frame 21. The boss mount portion 26 is provided so that a boss 25C of a swinging scroll 25 described later is mounted therein. The boss mount portion 26 is formed by downwardly recessing the center portion of the other surface (upper surface) of the main frame 21. An eccentric shaft portion 15A is formed at the tip (upper end) of the driving shaft 15. The eccentric shaft portion 15A is provided so that the center thereof is eccentric to the shaft center of the driving shaft 15, and it is turnably inserted in the boss 25C through a slewing bearing 24.

The scroll compression mechanism 11 is constructed by a fixed scroll 23 and a swinging scroll 25. The fixed scroll 23 is disposed in close contact with the upper surface of the main frame 21. The main frame 21 is secured to the inner surface of the casing body 5. The fixed scroll 23 is fastened and fixed to the main frame 21 by a screw 34. The swinging scroll 25 is engaged with the fixed scroll 23, and disposed in a swing space 12 formed between the fixed scroll 23 and the main frame 21. The inside of the casing 3 is partitioned into a high-pressure space 27 below the main frame 21 and a discharge space 29 above the main frame 21. The respective spaces 27 and 29 intercommunicate with each other through a longitudinal groove 71 which is formed on the outer peripheries of the main frame 21 and fixed scroll 23 so as to extend longitudinally.

A suction pipe 31 for introducing refrigerant in the refrigerant circuit to the scroll compression mechanism 11 is air-tightly fixed to the upper cap 7 of the casing 3 so as to penetrate through the upper cap 7. A discharge pipe 33 for discharging refrigerant in the casing 3 to the outside of the casing 3 is air-tightly fixed to the casing body 5 so as to penetrate through the casing body 5. The suction pipe 31 extends in the up-and-down direction in the discharge space 29. The inner end portion of the suction pipe 31 penetrates through the fixed scroll 23 of the scroll compression mechanism 11, and intercommunicates with a compression chamber 35. Refrigerant is sucked into the compression chamber 35 by the suction pipe 31.

The driving motor (DC driving motor) 13 is a DC (Direct Current) motor which is driven upon reception of input from a DC power source. The driving motor 13 has an annular stator 37 and a rotor 39 which is freely rotatably mounted in the stator 37. The driving motor 13 is driven while the rotation torque of the driving motor 13 is controlled by a PWM (Pulse Width Modulation) inverter which is supplied with a fixed input voltage to control the duty ratio of pulse waves, that is, a pulse wave output period and a pulse width when each pulse wave is output.

The swinging scroll 25 of the scroll compression mechanism 11 is connected to the rotor 39 through the driving shaft 15 to be driven. The stator 37 comprises a stator core 37A and a stator coil 18. The stator core 37A is formed by laminating thin iron plates (electromagnetic steel plates), and it has plural grooves (not shown) therein. The stator coil 18 is formed by winding stator windings of plural phases, and engagedly fitted in the grooves formed in the stator core 37A, whereby the stator coil 18 is provided at the upper and lower sides of the stator core 37A. The stator coil 18 is mounted in an insulator 19. The stator coil 18 is connected to the power supply terminal 53 through a conductive wire (not shown).

The rotor 39 is formed of ferrite magnet or neodymium magnet, and it is magnetized by magnetization. The rotor 39 is magnetized by a winding magnetizing method of interpolating the rotor 39 in the stator 37 and supplying current to the stator windings forming the stator coil 18 of the stator 37 to magnetize the interposed rotor 39. A holder (pin holder) 58 is pressed in the driving shaft 15 to position the rotor 39 when the winding magnetization is executed on the rotor 39.

The stator 37 is supported on the inner wall surface of the casing 3 through the annular spacer ring 38. The spacer ring 38 is fixed to the inner wall surface of the casing 3 by shrink fit, and the stator 37 is fixed to the inner wall surface of the spacer ring 38 by shrink fit. The upper end face of the spacer ring 38 is located at a lower position than the upper end face of the stator 37.

Figure 2A:
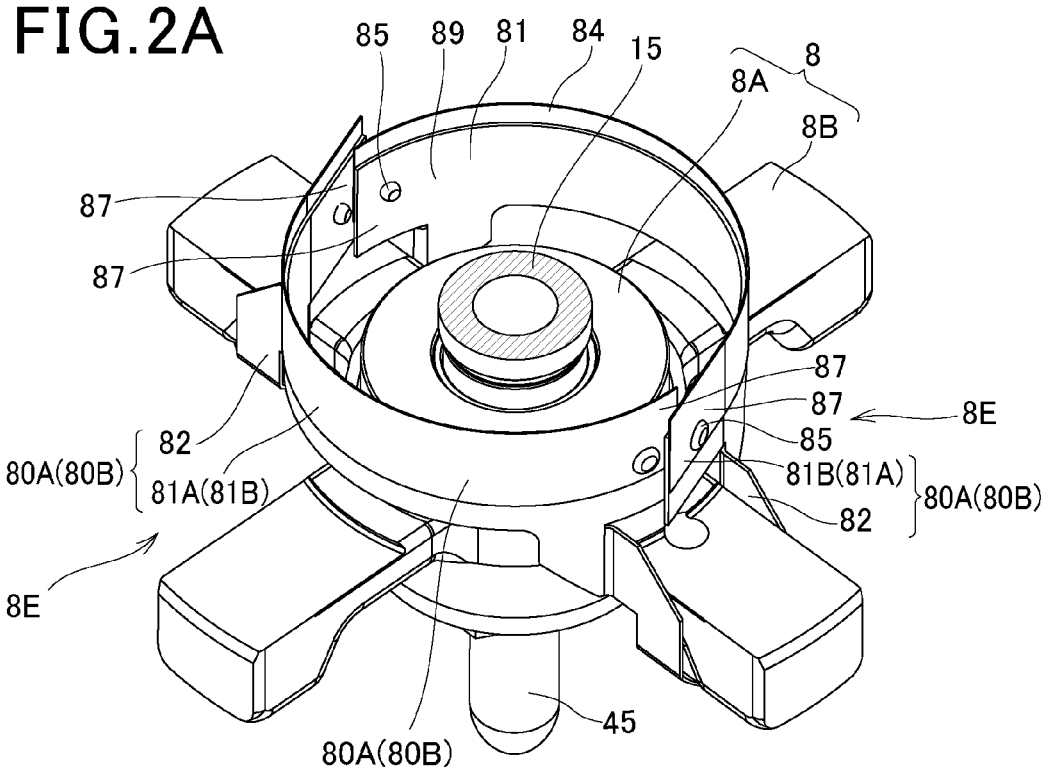
FIGS. 2A and 2B are perspective views of an assembly of a cover and a bearing plate.
Figure 2B:
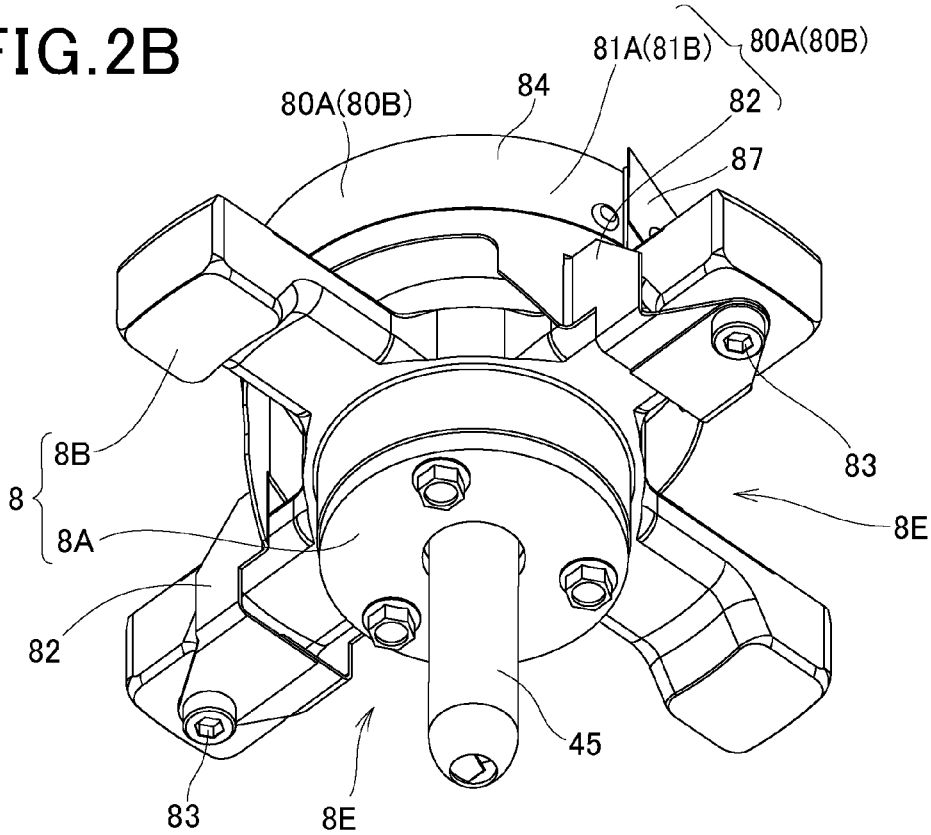

A bearing plate 8 is provided below the driving motor 13, and the lower end portion of the driving shaft 15 is pressed into the bearing plate 8 so as to be rotatably supported by the bearing plate 8. The bearing plate 8 is formed in a cylindrical (barrel-like) shape (see FIG. 2), and it has a boss portion 8A in which the driving shaft 15 is fitted and arm portions 8B fixed to (the inner surface of) the casing body 5. The arm portions 8B are provided on the periphery of the boss portion 8A substantially at an equal angular interval so as to extend in plural directions. In this embodiment, the four arm portions 8B are provided on the periphery of the boss portion 8A substantially at an angular interval of 90° so as to radially extend in four directions as shown in FIGS. 2A and 2B. That is, the driving shaft 15 is supported in the casing 3 by the bearing plate 8. The bearing plate 8 has opening portions (spaces) 8E (see FIG. 2) each of which is defined between the respective adjacent arm portions 8B and through which the upper and lower spaces of the bearing plate 8 intercommunicate with each other.

Figure 4:
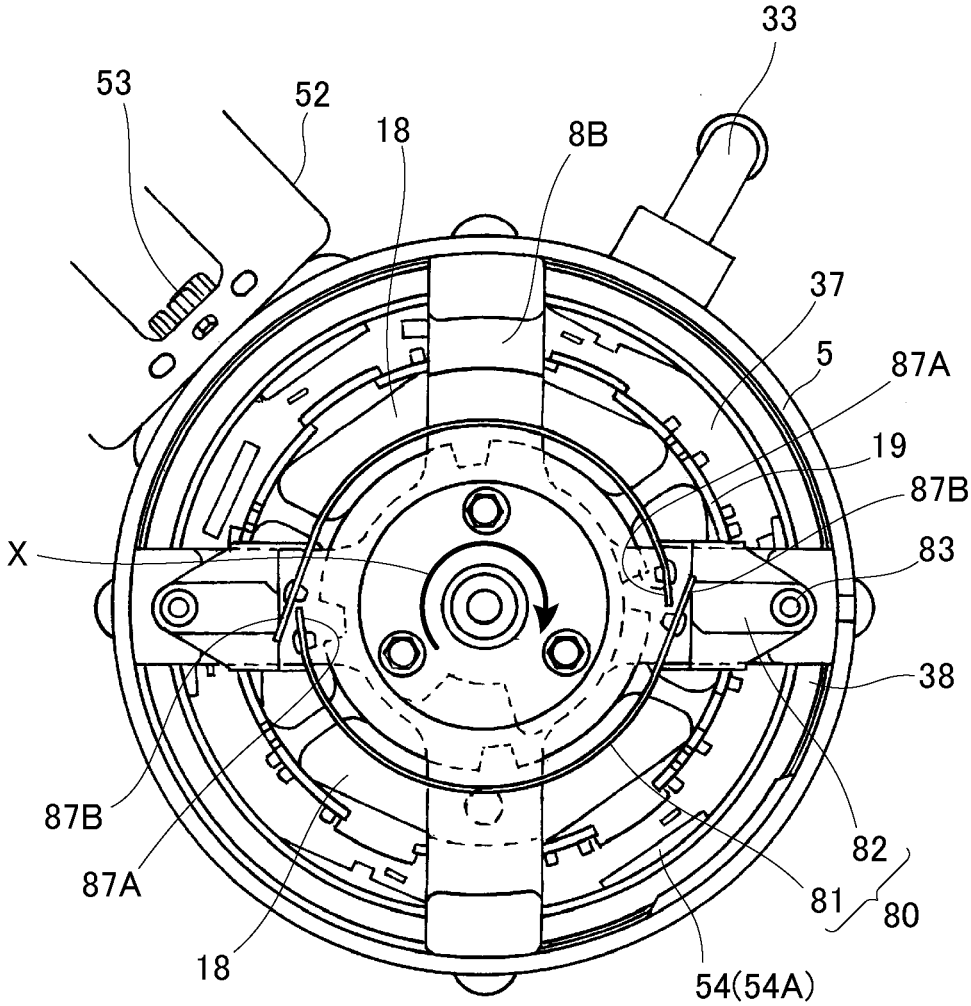
FIG. 4 is a bottom view showing the scroll compressor when the scroll compressor is viewed from the lower side under the state that an oil reservoir is detached.

A lower space which is located below the bearing plate 8 and in which an oil reservoir 40 is provided is kept under a high pressure. The lower cap 9 described above corresponds to the lower end portion of the oil reservoir 40. Oil is stocked at the inner bottom portion of the lower cap 9. A first cover (cover) 80 (see FIG. 4) is fixed to the bearing plate 8, and it has a cover portion 81 and fixing portion 82. The cover portion 81 protrudes to the upper side of the bearing plate 8, and extends to the neighborhood of the stator coil 18. The fixing portions 82 are formed integrally with the cover portion 81, and extend from the cover portion 81 through the opening portions 8E to the lower side of the bearing plate 8. The first cover 80 is integrally fixed to the bearing plate 8 so that the cover portion 81 covers the periphery in the shaft direction of the driving shaft 15 between the bearing plate 8 and the driving motor 13 and the fixing portions 82 are fixed to the arm portions 8B from the lower side of the bearing plate 8 by screws 83.

An oil supply path 41 as a part of high-pressure oil supply unit is formed in the driving shaft 15. The oil supply path 41 extends in the up-and-down direction in the driving shaft 15, and intercommunicates with an oil chamber 43 on the back surface of the swinging scroll 25. The oil supply path 41 is connected to an oil pickup 45 provided to the lower end of the driving shaft 15. A lateral hole which extends in the radial direction of the driving shaft 15 and penetrates through the oil supply path 41 is formed at the depth side of the oil pickup 45. The holder 58 described above is pressed in the lateral hole. The oil pickup 45 is pressed into the driving shaft 15 after the rotor 39 is magnetized.

The oil pickup 45 has a suction port 42 provided to the lower end thereof, and a paddle 44 formed at the upper side of the suction port 42. The lower end of the oil pickup 45 is immersed in lubricant oil stocked in the oil reservoir 40, and the suction port 42 of the oil supply path 41 is opened in the lubricant oil. When the driving shaft 15 rotates, the lubricant oil stocked in the oil reservoir 40 gets into the oil supply path 41 from the suction port 42 of the oil pickup 45, and pumped up along the paddle 44 of the oil supply path 41. The thus-pumped lubricant oil is supplied through the oil supply path 41 to the respective sliding portions of the scroll compression mechanism 11 such as the radial bearing portion 28, the slewing bearing portion 24, etc. The lubricant oil is further supplied through the oil supply path 41 to the oil chamber 43 on the back surface of the swinging scroll 25, and further supplied from the oil chamber 43 through an intercommunication path 51 provided to the swinging scroll 25 to the compression chamber 35.

A return oil path 47 is formed in the main frame 21. The return oil path 47 radially penetrates from the boss mount portion 26 through the main frame 21, and opens to the longitudinal groove 71. Surplus lubricant oil out of the lubricant oil supplied through the oil supply path 41 to the respective sliding portions of the scroll compression mechanism 11 and the compression chamber 35 is returned through the return oil path 47 to the oil reservoir 40. An oil collector 46 is provided below the return oil path 47. The oil collector 46 extends to the neighborhood of the upper end of the spacer ring 38. Plural cutouts 54 are formed on the outer peripheral surface of the stator 37 in the up-and-down direction of the stator 37. The lubricant oil which is returned from the oil supply path 41 through the return oil path 47 and the oil collector 46 passes through the cutouts 54 and the gaps between the respective arm portions 8E of the bearing plate 8 and then is returned to the oil reservoir 40. In the cross-sectional view of FIG. 1, the discharge pipe 33 is represented by a broken line for simplification of the description, but the discharge pipe 33 is disposed to be out of phase with the oil collector 46.

The fixed scroll 23 comprises a mirror plate 23A and a spiral (involute) wrap 23B formed on the lower surface of the mirror plate 23A. The swinging scroll 25 comprises a mirror plate 25A and a spiral (involute) wrap 25B formed on the upper surface of the mirror plate 25A. The wrap 23B of the fixed scroll 23 and the wrap 25B of the swinging scroll 25 are engaged with each other, whereby plural compression chambers 35 are formed by both the wraps 23B and 25B between the fixed scroll 23 and the swinging scroll 25.

The swinging scroll 25 is supported through an Oldham's ring 61 by the fixed scroll 23. The cylindrical boss 25C having a bottom is provided at the center portion of the lower surface of the mirror plate 25A of the swinging scroll so as to project from the lower surface. The eccentric shaft portion 15A is provided to the upper end of the driving shaft 15. The eccentric shaft portion 15A is rotatably fitted in the boss 25C of the swing scroll 25.

Furthermore, the driving shaft 15 is provided with a counter weight portion (upper balancer) 63 at the lower side of the main frame 21. The driving shaft 15 is also provided with a lower balancer 77 at the lower portion of the rotor 39. The driving shaft 15 keeps dynamic balance with the swinging scroll 25, the eccentric shaft portion 15A, etc. by the upper balancer 63 and the lower balancer 77. The driving shaft 15 rotates with keeping the weight balance by the counter weight portion 63 and the lower balancer 77 to make the swinging roll 25 revolve. In connection with the revolution of the swinging scroll, the volume between the wraps 23B and 25B in the compression chambers 35 decreases as the position approaches to the center, whereby refrigerant sucked through the suction pipe 31 is compressed. Furthermore, the rotor 39 and a regulation plate 55 are provided to the lower surface of the lower balancer 77. The regulation plate 55 is swaged integrally with the lower balancer 77 by a rivet 91. The regulation plate 55 is used to regulate the rotation of the rotor 39 when the rotor 39 is subjected to the winding magnetization.

A second cover 90 which is swaged integrally with the rotor 39 and the lower balancer 77 by a rivet 91 is secured between the rotor 39 and the lower balancer 77. The second cover 90 is configured in a cylindrical (barrel-like) shape so that plural holes through which the driving shaft 15 and the rivet 91 penetrate are formed in the upper surface 92 thereof and the lower thereof is opened. The lower end 93 of the second cover 90 extends to the neighborhood of the regulation plate 55, and the second cover 90 is disposed inside the first cover 80. The first cover 80 and the second cover 90 are arranged so that the lower end 93 of the second cover 90 and the upper end 88 of the first cover 80 are overlapped with each other in the up-and-down direction. The first cover 80 is disposed so that the cover portion 81 thereof is located outside the regulation plate 55 and also inside the center of the stator coil 18.

According to these constructions, the surrounding in the shaft direction of the driving shaft 15 can be covered by the first cover 80 and the second cover 90. Accordingly, lubricant oil which is atomized by the rotation of the driving shaft 15 can be enclosed inside the first cover 80 and the second cover 90. Furthermore, atomized lubricant oil which leaks from the lower end 93 of the second cover 90 to the outside of the second cover 90 can be enclosed inside the first cover 80. Accordingly, the atomized lubricant oil can be prevented from reaching a gas flow path, and the oil can be returned from the opening portions 8E to the oil reservoir, whereby the discharge amount of the lubricant oil to the outside of the casing can be reduced.

A cap 48 is fixed to the lower side of the main frame 21 so as to surround the periphery of the counter weight portion 63. The cap 48 prevents the lubricant oil leaking from the clearance between the main frame 21 and the driving shaft 15 from scattering to the discharge pipe side due to rotation of the counter weight portion 63.

A discharge hole 73 is provided to the center portion of the fixed scroll 23. Gas refrigerant discharged from the discharge hole 73 passes through a discharge valve 75, discharges through the discharge valve 75 to a discharge space 29 and flows out through the longitudinal groove 71 provided to the respective outer peripheries of the main frame 21 and the fixed scroll 23 to the high-pressure space 27 below the main frame 21. The high-pressure refrigerant which discharges from the discharge hole 73 and flows into the high-pressure space 27 is discharged to the outside of the casing 3 through the discharge pipe 33 provided to the casing body 5.

Subsequently, the driving operation of the scroll compressor 1 will be described.

When the driving motor 13 is driven, the rotor 39 rotates relatively to the stator 37, and the driving shaft 15 also rotates in connection with the rotation of the rotor 39. When the driving shaft 15 rotates, the swinging scroll 25 of the scroll compression mechanism 11 only revolves around the fixed scroll 23 without rotating on its axis. Accordingly, low-pressure refrigerant is sucked from the peripheral edge side of the compression chamber 35 through the suction pipe 31 into the compression chambers 35, and this refrigerant is compressed in connection with the volume variation of the compression chambers 35. The compressed refrigerant is set to high pressure, and discharged from the compression chambers 35 through the discharge valve 75 to the discharge space 29. The high-pressure refrigerant discharged to the discharge space 29 flows out to the high-pressure space 27 below the main frame 21 through the longitudinal groove 71 provided to the respective outer peripheries of the main frame 21 and the fixed scroll 23. The high-pressure refrigerant flowing into the high-pressure space 27 is discharged to the outside of the casing 3 through the discharge pipe 33 provided to the casing body 5. After the refrigerant discharged to the outside of the casing 3 is circulated in the refrigerant circuit (not shown), the refrigerant is passed through the suction pipe 31 again and sucked into the scroll compressor 1 to be compressed. The circulation of the refrigerant as described above is repeated.

Next, the flow of the lubricant oil will be described.

The lubricant oil stocked at the internal bottom portion of the lower cap 9 in the casing 3 is pumped up by the oil pickup 45, passed through the oil supply path 41 of the driving shaft 15 and supplied to the respective sliding portions of the scroll compression mechanism 11 and the compression chamber 35. The lubricant oil which is surplus at the respective sliding portions of the scroll compression mechanism 11 and the compression chamber 35 is collected from the return oil path 47 into the oil collector 46, passed through the cutouts 54 provided to the outer periphery of the stator 37 and returned to the lower side of the driving motor 13.

When the rotor 39 is magnetized by the winding magnetization, it is necessary to insert a jig from the opening portion 8E of the bearing plate 8 to fix the regulation plate 55 and regulate (stop) the rotation of the rotor 39 when the rotor 39 is magnetized. When the winding magnetization is performed under the state that the first cover 80 is disposed between the driving motor 13 and the bearing plate 8, there is a case that the first cover acts as an obstacle which makes it difficult to fix the regulation plate 55 firmly. In this case, the magnetization cannot be performed with high efficiency. Therefore, it is necessary to secure the first cover 80 after the rotor 39 is magnetized. In this embodiment, the first cover 80 is divided into two cover members 80A and 80B, and it can be secured after the rotor 39 is magnetized by the winding magnetization. The construction of the first cover 80 will be described in detail.

FIGS. 2A and 2B show the bearing plate 8 disposed below the driving motor 13 and the first cover 80 secured to the bearing plate 8. Specifically, FIG. 2A is a perspective view showing the bearing plate 8 and the first cover 8 when they are viewed from the upper side. FIG. 2B is a perspective view showing he bearing plate 8 and the first cover 80 when they are viewed from the lower side.

As shown in FIGS. 2A and 2B, the driving shaft 15 and the oil pickup 45 are inserted in the boss portion 8A of the bearing plate 8. The first cover 80 may be divided into plural (two or more) cover members (two cover members 80A and 80B in this embodiment). The first cover 80 or each of the cover members 80A and 80B (when the first cover is divided into the cover members 80A and 80B) is configured so as to be passable through the gap between the adjacent arm portions 8E of the bearing plate 8, that is, through the opening portion (space) 8E to secure the first cover 80 to the bearing plate. Specifically, each cover portion 81A, 81B and each fixing portion 82A, 82B are configured to be passable through the gap between the adjacent arm portions 8E of the bearing plate 8, that is, through the opening portion (space) 8E to secure the first cover 80 to the bearing plate 8. That is, the first cover 80 or each of the cover members 80A and 80B is configured in such a size as to be passable through the gap between the adjacent arm portions 8E of the bearing plate 8.

In this embodiment, the first cover 80 is configured to be divided into the two cover members 80A and 80B, but it may be divided into plural (two or more) cover members.

Figure 3:
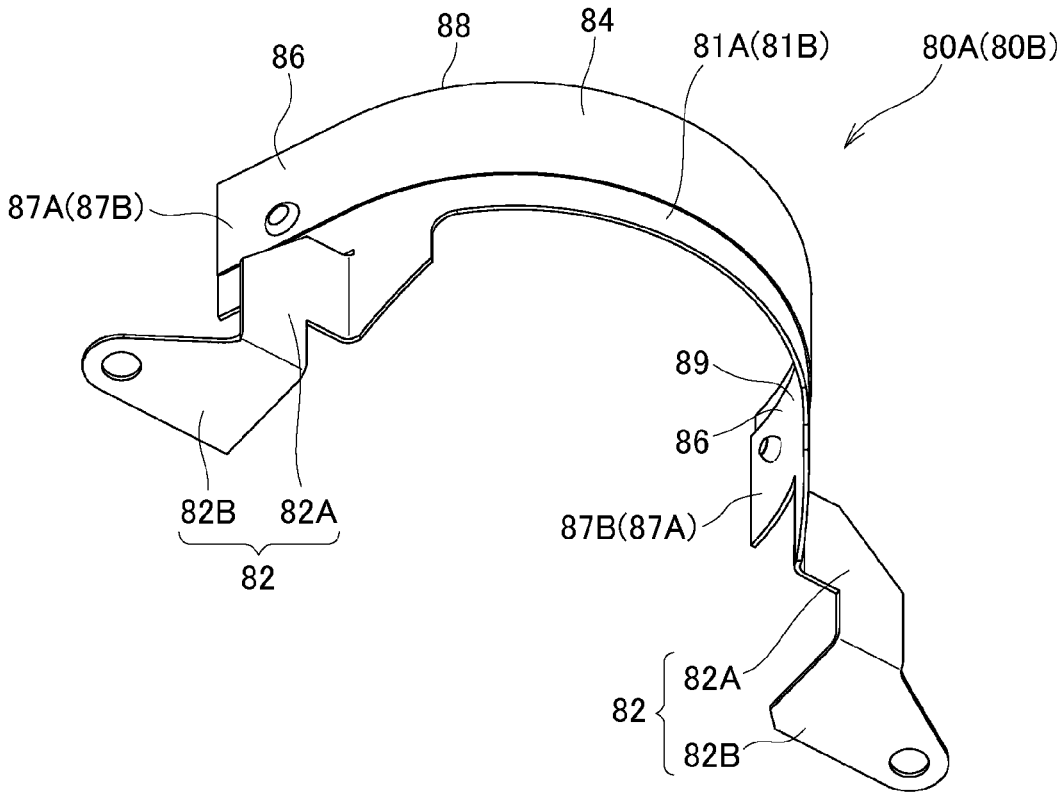
FIG. 3 is a perspective view showing a cover member.

The first cover 80 is configured so that the surrounding of the driving shaft 15 is covered between the bearing plate 8 and the driving motor 13 by the cover portions 81A and 81B when the respective cover members 80A and 80B are secured to the bearing plate 8 in combination with each other. The cover portions 81A and 81B extends to the stator coil 18 above the bearing plate 8. As shown in FIG. 3, the cover members 80A and 80B have fixing portions 82 in the neighborhood of both the end portions 86 of the cover portions 81A and 81B. Each of the cover portions 81A and 81B is formed of a thin plate member which is configured in a substantially semispherical or arcuate shape around the driving shaft 15 as the axial center. The first cover 80 is configured in a substantially circular shape so that the surrounding of the driving shaft 15 is surrounded by the first cover 80 with the cover portions 81A and 81B being combined with each other.

Each of the fixing portions 82 has a support portion 82A extending in the opposite direction to the extension direction of the cover portions 81A, 81B, and a fixing portion 82B which is formed so as to extend from the support portion 82A and be folded along the lower surface of the arm portion 8B of the baring plate 8. That is, the respective cover members 80A and 80B are formed to have such shapes and sizes that the respective fixing portions 82 are fixed to the arm portions 8B of the bearing plate 8 from the lower side thereof.

An insulating sheet (insulator) 84 extending upwardly from the upper end of the cover portion body 89 is secured over the whole cover portions 81A, 81B in the peripheral direction thereof. The insulating sheet 84 is secured to the cover portion body 89 by a rivet or a clamp 85 such as a snap or the like. According to this construction, the insulating sheet 84 is provided at the upper end portions of the cover portions 81A, 81B extending to the neighborhood of the stator coil 18 so as to extend in the peripheral direction. Therefore, even when the first cover 80 is formed of metal or the like, the first cover 80 and the stator coil 18 can be insulated from each other. The first cover 80 may be constructed so that the cover portions 81A and 81B or the whole body of the first cover 80 is formed of material having excellent insulation properties in place of the construction that the insulating sheet is secured to the first cover 80. Alternatively, the first cover 80 may be coated with resin having excellent insulation properties or the like so that the first cover 80 and the stator coil 18 are insulated from each other.

According to this construction, the first cover 80 comprises plural cover members 80A and 80B, and the cover members 80A and 80B have the cover portions 81A and 81B which are formed to have such sizes that the cover portions 81A and 81B pass through the opening portions 8E, and the fixing portions 82 for fixing the cover members 80A and 80B to the arm portions 8B from the lower side of the bearing plate 8. Accordingly, the first cover 80 may be secured so that the rotor 39 is interposed in the stator 37 and magnetized by the winding magnetization, and then the surrounding in the shaft direction of the driving shaft 15 is covered by the first cover 80 between the bearing plate 8 and the driving motor 13. Therefore, the lubricant oil which is atomized due to the rotation of the driving shaft 15 can be enclosed inside the first cover 80, and the oil can be returned to the oil reservoir. In addition, the atomized lubricant oil can be prevented from reaching the gas flow path, so that the discharge amount of the lubricant oil to the outside of the casing can be reduced.

The both the end portions 86 of the cover portions 81A and 81B extend from the fixing portions 82 in the peripheral direction of the cover portions 81A and 81B. When the cover members 80A and 80B are secured to the bearing plate 8 while combined with each other, the respective adjacent end portions 87A, 87B in the peripheral direction of one cover portion 81A and the other cover portion 81B are radially overlapped with each other. With respect to the end portions 87A and 87B, the front end 87A in the rotational direction of the one cover portion 81A is disposed inside the rear end 87B in the rotational direction of the other cover portion 81B, and also the front end 87A of the other cover portion 81B is disposed inside the rear end in the rotational direction of the one cover portion 81A. That is, the cover members 80A and 80B are assembled with the bearing plate 8 so that the end portions 86 thereof are radially overlapped with each other under the state that the front ends 87A in the rotational direction thereof are arranged inside the rear ends 87B thereof. Accordingly, atomized refrigerant which is radially scattered from the inside front ends 87A by centrifugal force is blocked by the outside rear ends 87B. Accordingly, a gap can be prevented from being formed along the rotational direction X of the driving shaft 15 between the adjacent front and rear ends 87A and 87B in the rotational direction of the cover members 80A and 80B.

According to this construction, the atomized lubricant oil enclosed inside the first cover 80 can be prevented from flowing along the rotational direction X of the driving shaft 15 in connection with the rotation of the driving shaft 15 and leaking from the gap between the end portions 86 to the outside of the first cover 80. Accordingly, the atomized lubricant oil can be prevented from reaching the gas flow path and thus being discharged to the outside of the casing.

As described above, according to the embodiment to which the present invention is applied, the scroll compression mechanism 11 for compressing the refrigerant and the driving motor 13 which is connected to the scroll compression mechanism 11 through the driving shaft 15 to drive the scroll compression mechanism 11 are mounted in the casing 3, the scroll compression mechanism 11 is supported in the casing 3 by the main frame 21, the driving shaft 15 of the driving motor 13 is supported in the casing 3 by the bearing plate 8, the bearing plate 8 has the opening portions 8E intercommunicating with the upper and lower spaces, the cover 80 covering the surrounding of the driving shaft 15 between the driving motor 13 and the bearing plate 8 is provided, and the cover 80 is divided into the plural cover members 80A and 80B which are configured in such a size that they pass through the opening portions 8E. Accordingly, in a case where the rotor 39 of the driving motor 13 is magnetized, even when the rotor 39 is interposed in the stator 37 and then magnetized by the winding magnetization, the cover 80 which covers the periphery in the shaft direction of the driving shaft 15 after the magnetization can be secured between the bearing plate 8 and the driving motor 13. Therefore, irrespective of the specification of the magnetization, the cover 80 for preventing the lubricant oil atomized due to the rotation of the driving shaft 15 from reaching the gas flow path can be secured between the driving motor 13 and the bearing plate 8, and the discharge amount of the lubricant oil to the outside of the casing 3 can be reduced.

According to the embodiment to which the present invention is applied, each of the cover members 80A and 80B is integrally provided with the cover portion 81 disposed above the bearing plate 8 and the fixing portions 82 for fixing the cover portion 81 to the bearing plate 8 from the lower side of the bearing plate 8. Accordingly, even when the rotor 39 is interposed in the stator 37 and then magnetized by the winding magnetization in the magnetization process of the rotor 39 of the driving motor 13, the cover members 80A and 80B can be easily fixed to the bearing plate 8 from the lower side of the bearing plate 8 after the magnetization, and the cover portions 81 can be provided between the bearing plate 8 and the driving motor 13 so as to cover the surrounding in the shaft direction of the driving shaft 15. Accordingly, irrespective of the specification of the magnetization, the cover 80 for preventing the lubricant oil atomized due to the rotation of the driving shaft 15 from reaching the gas flow path can be easily secured between the driving motor 13 and the bearing plate 8, and the discharge amount of the lubricant oil to the outside of the casing 3 can be reduced.

Furthermore, according to the embodiment to which the present invention is applied, with respect to the cover 80, the adjacent end portions 87 in the peripheral direction of one cover portion 81A and the other cover portion 81B are overlapped with each other (laterally (horizontally), for example), and also the front end 87A in the rotational direction of the one cover portion 81A is located inside the rear end 87B in the rotational direction of the other cover portion 81B. Accordingly, even when the cover 80 are constructed by the plural cover members 80A and 80B, the atomized lubricant oil flowing along the rotational direction X of the driving shaft 15 can be prevented from flowing out through the gap between the respective cover members 80A and 80B to the outside of the cover 80. Accordingly, the lubricant oil atomized due to the rotation of the driving shaft 15 can be prevented from reaching the gas flow path, and the discharge amount of the lubricant oil to the outside of the casing 3 can be reduced.

According to the embodiment to which the present invention is applied, the insulators 84 are provided to the upper edge portion of the cover 80 (the upper portions of the cover members 80A and 80B). Accordingly, the cover 80 can be formed of metal, and designed to have any shape by bending the metal. Even when the upper edge portion of the cover 80 is provided to extend to the neighborhood of the stator coil 18, the cover 80 and the stator coil 18 can be insulated from each other.

Furthermore, according to the embodiment to which the present invention is applied, the driving motor 13 has the second cover 90 which covers the surrounding of the driving shaft 15 and is opened to the lower side. The second cover 90 is disposed inside the cover 80, and the upper end of the cover 80 and the lower end of the second cover 90 are overlapped with each other in the up-and-down direction. Accordingly, the lubricant oil which is atomized due to the rotation of the driving shaft 15 can be enclosed inside the first cover 80 and the second cover 90. Furthermore, the atomized lubricant oil leaking from the lower end 93 of the second cover 90 to the outside of the second cover 90 can be enclosed inside the first cover 80. Therefore, the atomized lubricant oil can be prevented from reaching the gas flow path, and the oil can be returned from the opening portion 8E into the oil reservoir.

Therefore, the discharge amount of the lubricant oil to the outside of the casing 3 can be reduced.

What is claimed is:

1. A scroll compressor, comprising:

a casing;

a scroll compression mechanism that compresses refrigerant;

a driving motor that has a driving shaft and is connected to the scroll compression mechanism through the driving shaft to drive the scroll compression mechanism;

a main frame that supports the scroll compression mechanism in the casing;

a bearing plate that supports the driving shaft of the driving motor in the casing and has an opening portion through which upper and lower spaces above and below the bearing plate intercommunicate with each other; and a first cover that covers a surrounding of the driving shaft between the driving motor and the bearing plate, wherein the cover is configured so as to be passable through the opening portion, wherein the first cover is divided into plural cover members each of which is configured so as to be passable through the opening portion, and the cover members are secured to the bearing plate so that front and rear end portions in a rotational direction of adjacent cover members are radially overlapped with each other and the front end in the rotational direction of one of the adjacent cover members is arranged inside a rear end in the rotational direction of the other cover member.

2. The scroll compressor according to claim 1, wherein each of the cover members comprises a cover portion disposed above the bearing plate and a fixing portion for fixing the cover portion to the bearing plate from the lower side of the bearing plate.

3. The scroll compressor according to claim 1, wherein the first cover is provided with an insulator at an upper edge portion of the first cover.

4. The scroll compressor comprising:

a casing;

a scroll compression mechanism that compresses refrigerant;

a driving motor that has a driving shaft and is connected to the scroll compression mechanism through the driving shaft to drive the scroll compression mechanism;

a main frame that supports the scroll compression mechanism in the casing;

a bearing plate that supports the driving shaft of the driving motor in the casing and has an opening portion through which upper and lower spaces above and below the bearing plate intercommunicate with each other; and a first cover that covers a surrounding of the driving shaft between the driving motor and the bearing plate, wherein the cover is configured so as to be passable through the opening portion, wherein the driving motor is provided with a second cover that covers the surrounding of the driving shaft and is opened to the lower side of the second cover, the second cover is disposed inside the first cover, and the first cover and the second cover are arranged so that an upper end of the first cover and a lower end of the second cover are overlapped with each other in an up-and-down direction.

* * * * *